US006684524B1

(12) United States Patent
Sennhenn et al.

(10) Patent No.: US 6,684,524 B1
(45) Date of Patent: Feb. 3, 2004

(54) LYOPOHILIZATION METHOD

(75) Inventors: Bernd Sennhenn, Leverkusen (DE); Martin Kramer, Stuttgart (DE)

(73) Assignee: Bayer Aktiengesellschaft, Leverkusen (DE)

( * ) Notice: Subject to any disclaimer, the term of this patent is extended or adjusted under 35 U.S.C. 154(b) by 0 days.

(21) Appl. No.: 10/048,783

(22) PCT Filed: Jul. 21, 2000

(86) PCT No.: PCT/EP00/07034

§ 371 (c)(1),
(2), (4) Date: Feb. 1, 2002

(87) PCT Pub. No.: WO01/09559

PCT Pub. Date: Feb. 8, 2001

(30) Foreign Application Priority Data

Aug. 2, 1999 (DE) ..... 199 36 281

(51) Int. Cl.[7] ..... F26B 5/06

(52) U.S. Cl. ..... 34/287; 34/284; 34/298; 34/402

(58) Field of Search ..... 34/284–287, 298, 34/402, 428

(56) References Cited

U.S. PATENT DOCUMENTS

| | | | | | |
|---|---|---|---|---|---|
| 3,233,333 | A | | 2/1966 | Oppenheimer | 34/5 |
| 4,520,574 | A | | 6/1985 | Sugisawa et al. | 34/5 |
| 4,612,200 | A | | 9/1986 | Sato | 426/242 |
| 5,199,187 | A | * | 4/1993 | Sutherland | 34/92 |
| 5,687,490 | A | * | 11/1997 | Harrison | 34/92 |
| 5,727,333 | A | * | 3/1998 | Folan | 34/285 |
| 5,822,882 | A | * | 10/1998 | Anger | 34/296 |
| 5,852,880 | A | * | 12/1998 | Harrison | 34/92 |
| 5,884,413 | A | * | 3/1999 | Anger | 34/92 |
| 5,884,414 | A | * | 3/1999 | Anger | 34/92 |
| 5,948,144 | A | * | 9/1999 | Cifuni | 95/246 |
| 5,996,248 | A | * | 12/1999 | Coppa et al. | 34/417 |
| 6,163,979 | A | * | 12/2000 | Oetjen et al. | 34/286 |
| 6,311,409 | B1 | * | 11/2001 | Coppa et al. | 34/92 |
| 2002/0099043 | A1 | * | 7/2002 | Akimoto et al. | 514/184 |
| 2002/0121099 | A1 | * | 9/2002 | Lambert et al. | 62/135 |
| 2002/0124431 | A1 | * | 9/2002 | Duhaut et al | 34/417 |

FOREIGN PATENT DOCUMENTS

JP 2-306088 A * 12/1990 ..... F26B/25/18

OTHER PUBLICATIONS

Williams, N., Polli, G., "The Lyophilization of Pharmaceuticals: A Literature Review", J. Parenteral Sci. & Tech., 38: 48–59 (1984).

Rey, L.,"Basic Aspects and Future Trends in the Freeze–Drying of Pharmaceuticals", Develop. Biol. Standard (Karger, Base), 74:3–8 (1991).

Rey, L., "Fundamental Aspects of Lyophilization", Researches and Development in Freeze–Drying, ed. by L. Rey, Paris, 1964, 23–43.

Essig, D., Oschmann, R., Schwabe, W., "Lyophilization", Wissenschaftliche Verlagsgesellsehaft Stuttgart mbH, 1993, Seite 15–29.

Rupprecht, H., "Physikalisch–Chemische Grundlagen Der Gefriertrocknung:", VCH Verlag. 1997, 13–38

"Freeze Drying, Athanasios I. Liapis, in: Handbook of Industrial Drying", ed. by A. S. Mujumdar, Montreal, Seite 295–326.

Adams, G., "Freeze Drying of Biological Materials", Drying Technology, US, Marcel Dekker, New York. vol. 9, 1991, 891–925.

* cited by examiner

*Primary Examiner*—Ira S. Lazarus
*Assistant Examiner*—Andrea M. Ragonese

(57) ABSTRACT

The invention relates to a lyophilization method which comprises the following steps: reducing the pressure in the drying chamber until the onset of a visible crystallization of the solvent at a temperature in the drying chamber which is above the solidification point of the preparation; reducing the temperature in the drying chamber to a temperature which is below the solidification point of the preparation or is identical to it, until completion of the crystallization of the solvent, resulting in a frozen solvent; and sublimation of the frozen solvent by means of reduced pressure.

9 Claims, 7 Drawing Sheets

LYOPOHILIZATION METHOD

The present invention relates to a novel freeze-drying (lyophilization) method.

Freeze-drying is an important method for stabilizing hydrolysis-sensitive and thermolabile preparations, and of materials of biological origin which are to be dried under gentle conditions. Using freeze-drying, materials can be dried without relatively great changes or losses of biological activity. A beneficial aspect of freeze-drying is that the dried, "lyophilic" products, owing to their porous structure and very high specific surface area, can be very rapidly reconstituted and regain their original properties in solution. Therefore, freeze-drying is preferably used for therapeutic sera, blood products, biologically active substances (hormones, vitamins, enzymes, medicaments), food preparations and flavorings. Suitable preparations for freeze-drying are liquid and semi-solid aqueous preparations, for example solutions, emulsions and suspensions.

Drying from the frozen state combines the advantages of freezing and dehydration at low temperature and is generally carried out in the following manner:

- cooling and crystallization of the solvent in the preparation at atmospheric pressure.
- main drying, that is to say sublimation of the crystallized solvent.
- further drying, that is to say evaporation of noncrystallized solvent fractions.

The two drying steps differ in principle: during the main drying (primary drying) the frozen solvent is sublimated under reduced pressure. During the optional further drying (secondary drying) nonfrozen solvent evaporates at reduced pressure and at elevated temperature.

In the methods known from the prior art, the preparations to be dried are frozen in vessels, termed vials, at atmospheric pressure and the product temperature is set to a value suitable for starting the main drying.

Freezing (crystallization) is followed by the main drying, during which at reduced pressure the frozen solvent is converted from the solid to the gaseous aggregate state, that is to say is sublimated. The energy which is consumed during sublimation is supplied, for example, via heatable adjustable shelves. During the main drying the frozen preparation must not heat up above its melting point. The main drying can be followed by further drying, in which the nonfrozen solvent is removed at elevated temperature and reduced pressure. This involves solvent which can be, for example, adsorbed on the solid matrix, or enclosed in amorphous areas. Crystallization in the present application is taken to mean freezing (solidification) the solvent in the preparation. Preparation in the present application is taken to mean any type of material which is suitable for freeze-drying.

The temperature course during freeze-drying can be controlled by suitable apparatuses. Those which are known to those skilled in the art are, in particular, thermostatable adjustable shelves. The adjustable shelves can, in this method, be brought to the desired freezing temperature both after loading (cooling variant A) and before loading (cooling variant B). It is also possible to precool the plates and/or the preparation on the plates to a temperature above the actual freezing temperature in order to ensure temperature uniformity of the individual vials or to minimize the cooling time before freezing. This is followed by the actual freezing with further lowering of the shelf temperature (cooling variant C). Variants A–C describe freezing on adjustable shelves. Other known methods are freezing methods in cooling baths and rotating vessels (shell freezing, spin freezing) or by spray apparatuses; they differ in principle from the methods described above. Usually, the preparations to be dried are aqueous systems. In principle, other solvents or their mixtures with aqueous systems can also be used, for example carboxylic acids (for example glacial acetic acid), dimethyl sulfoxide (DMSO), ether (for example dioxane), dimethylformamide or alcohols (for example t-butanol).

The various conventional types of freezing and of freeze-drying are adequately described, for example in relevant text books, for example Lyophilization, Essig, Oschmann, Wissenschaftliche Verlagsgesellschaft Stuttgart mbH, 1993; pages 15–29, Gefriertrocknen [freeze-drying], Georg-Wilhelm Oetjen, VCH Verlag, 1997; pages 3–58, and Freeze Drying, Athanasios I. Liapis, in: Handbook of Industrial Drying, ed. by A. S. Mujumdar, Montreal, page 295–326.

All freezing methods have in common the fact that, if the preparation is suitable, after the freezing a tempering step (thermal treatment or annealing) can be performed. This tempering step serves to promote the crystallization of amorphously solidified solids and nonfrozen solvents and thus to achieve an increased crystallinity and reduced residual moisture. To carry it out, the frozen preparation is heated to a temperature which is above the glass transition temperature (Tg') of the amorphously solidified solution and is below the melting point of the solution. The amorphous phase, which generally has high contents of noncrystallized solvent, is converted from the glass state to the rubberlike state and the mobility of molecules is increased. The consequence is the formation of nucleoli that grow to form crystals (eruptive recrystallization) and the addition of solvent molecules to pre-existing solvent crystals.

The tempering method is also known in the literature. Descriptions of the tempering method may be found in The Lyophilization of Pharmaceuticals: A Literature Review, N. A. Williams and G. P. Polli, Journal of Parenteral Science and Technology, (March–April 1984) 38 (2) 48–59, Basic Aspects and Future Trends in the Freeze-Drying of Pharmaceuticals, L. Rey, Develop. biol. Standart., Vol. 74, (Karger, Basel, 1991), pp. 3–8 und Fundamental Aspects of Lyophilization, L. Rey, Researches and Development in Freeze-Drying, ed. by L. Rey, Paris, 1964, 24–47.

The lyophilizates produced using the freeze-drying methods of the prior art mostly have a high resistance to flow, which hinders the escape of gaseous solvent. In addition, the dissolved constituents may not crystallize out completely or at all, so that products are obtained which are partly to completely amorphous. The consequences which can result from this are mechanical damage of the product cake due to the escaping solvent vapor stream and as a result potential loss of product, and collapsing and thawing phenomena during drying. Furthermore, the end user also imposes esthetic requirements in particular on pharmaceutical and food preparations, so that severe damage is not desired.

An object of the present invention was therefore to find a freeze-drying method using which lyophilizates may be produced which do not have the abovementioned problematic properties and are therefore easier to handle.

Surprisingly, it has now been found that lyophilizates which are more mechanically stable are obtained if the freeze-drying method is carried out as follows:

- Phase 1: Reducing the pressure in the drying chamber until the onset of a visible crystallization of the solvent at a temperature in the drying chamber which is above the solidification point of the preparation.
- Phase 2: Reduction of the temperature in the drying chamber to a temperature which is below the solidification point of the preparation or is identical to this, until completion of crystallization of the solvent.

Phase 3: Sublimation of the frozen solvent by means of reduced pressure.

By the solidification point of the preparation there is meant in the present application the temperature at which the solvent in the preparation is transformed into the solid aggregate state.

According to the invention the pressure in the drying chamber at the start, with a temperature in the drying chamber which is above the solidification point of the preparation, is reduced to a pressure below atmospheric pressure (according to FIG. 1). This causes a surface cooling of the preparation by evaporation and partial crystallization of the solvent on the surface (phase 1). In a preferred embodiment the pressure in this case with aqueous solutions is 0.1 to 6 mbar, in particular 0.2 to 3 mbar. This pressure p in the drying chamber (measured using a capacity manometer) is plotted for various preparations as a function of the concentration c (in mol/L) in FIG. 1. The values for various aqueous preparations was shown as follows:

continuous line, squares=mannitol continuous line, circles=sucrose continuous line, lozenges=sodium chloride dashed line, circles=glycine dashed line, triangles=maltose square on the y-axis=solvent water This pressure reduction can be performed, for example, at room temperature. In a further embodiment the preparations, before or during the pressure reduction, are precooled to a temperature which is between room temperature and the solidification point of the preparation. This precooling (for example on adjustable shelves) further ensures that the cooling apparatuses which sometimes have low cooling rates, can be brought in a short time to the desired crystallization temperature, that is to say in the region of the solidification point of the preparation. It is critical that this precooling does not lead to crystallization of the solvent.

If crystals have formed, for example in the form of a water/ice mixture or an ice layer floating on the surface, the pressure in the drying chamber can be raised again to ambient pressure and the temperature in the drying chamber for crystallization can be brought to or below the solidification point of the preparation (phase 2). It is also possible to keep the pressure reduced during the crystallization; this has no relevant effects on the solvent crystallization. In principle, for the crystallization, any temperature is suitable which is below the solidification point of the preparation or is identical to it. In a preferred embodiment, the temperature for the crystallization in the case of aqueous solutions is between −60° C. and 0° C.

After crystallization, the preparation, if appropriate, is brought to the final temperature for the start of drying. This temperature depends on the product present and, via the vapor pressure curve of the solvent, on the pressure which is to be used in the primary drying. In a preferred embodiment this temperature in the case of aqueous solutions is −60° C. to 0° C.

The primary drying then follows. This proceeds in principle as in the methods according to the prior art. In a further embodiment the method additionally has a secondary drying phase (phase 4) after the primary drying. However, in the event of a tempering phase (phase 2*a*), this is not necessary in some cases.

According to a further embodiment, a tempering method as described above follows phase 2. This tempering method is designated below as phase 2*a*. Tempering gives products with higher crystallinity and lower residual moisture after the primary drying and shortens the secondary drying or makes it superfluous.

The inventive method is to be described in more detail by FIGS. 2 to 7: Here the temperature (T) and the pressure (p) in millibars (mbar) in the drying chamber are plotted against time t, the temperature being shown as a continuous line and the pressure as a dashed line. For better explanation of the methods, the figures always show embodiments having primary and secondary drying.

Figure 4:
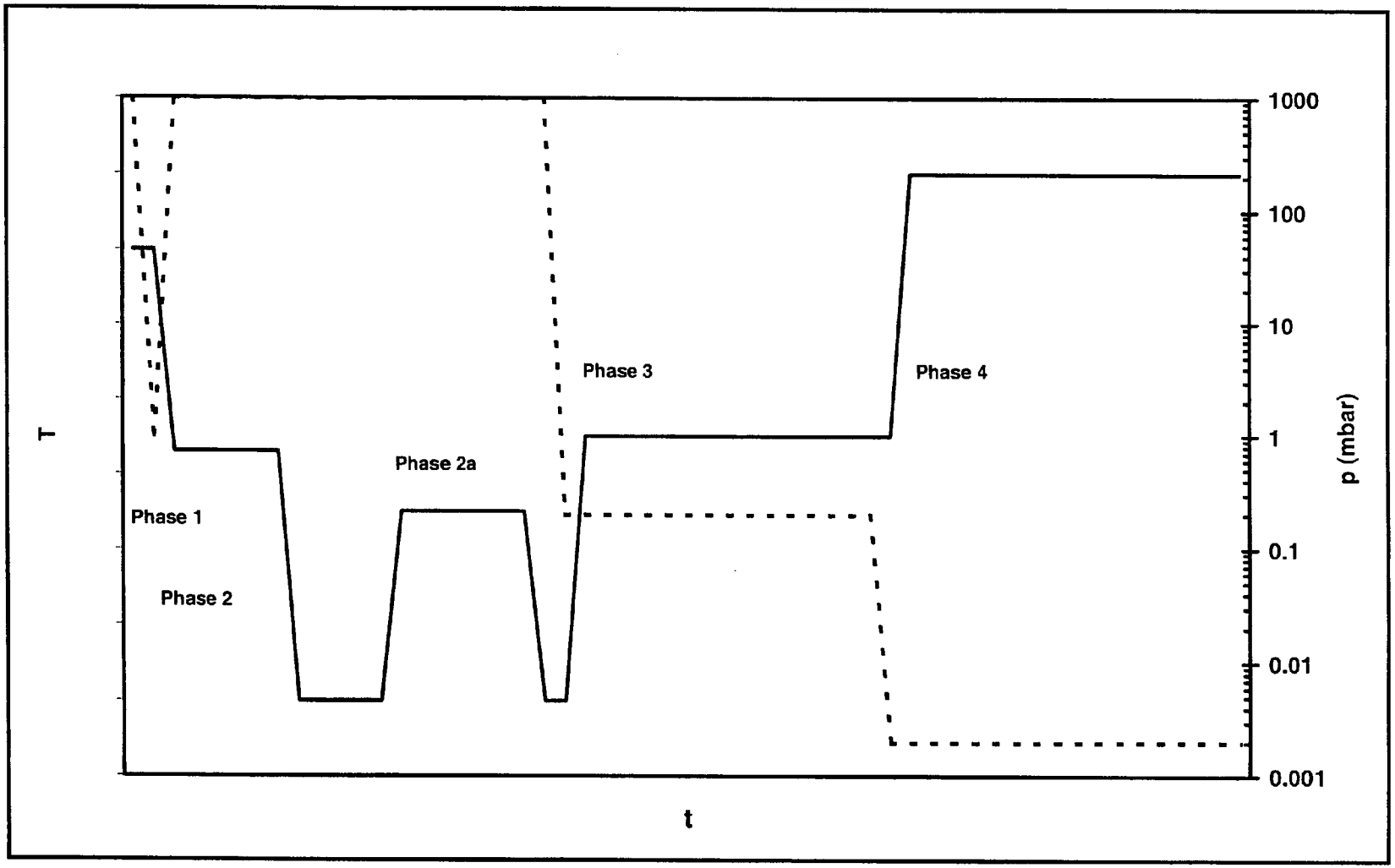

FIG. 4 shows the inventive method having pressure reduction (phase 1), crystallization (phase 2), tempering step (phase 2*a*) and subsequent primary and secondary drying (phases 3 and 4).

Figure 5:
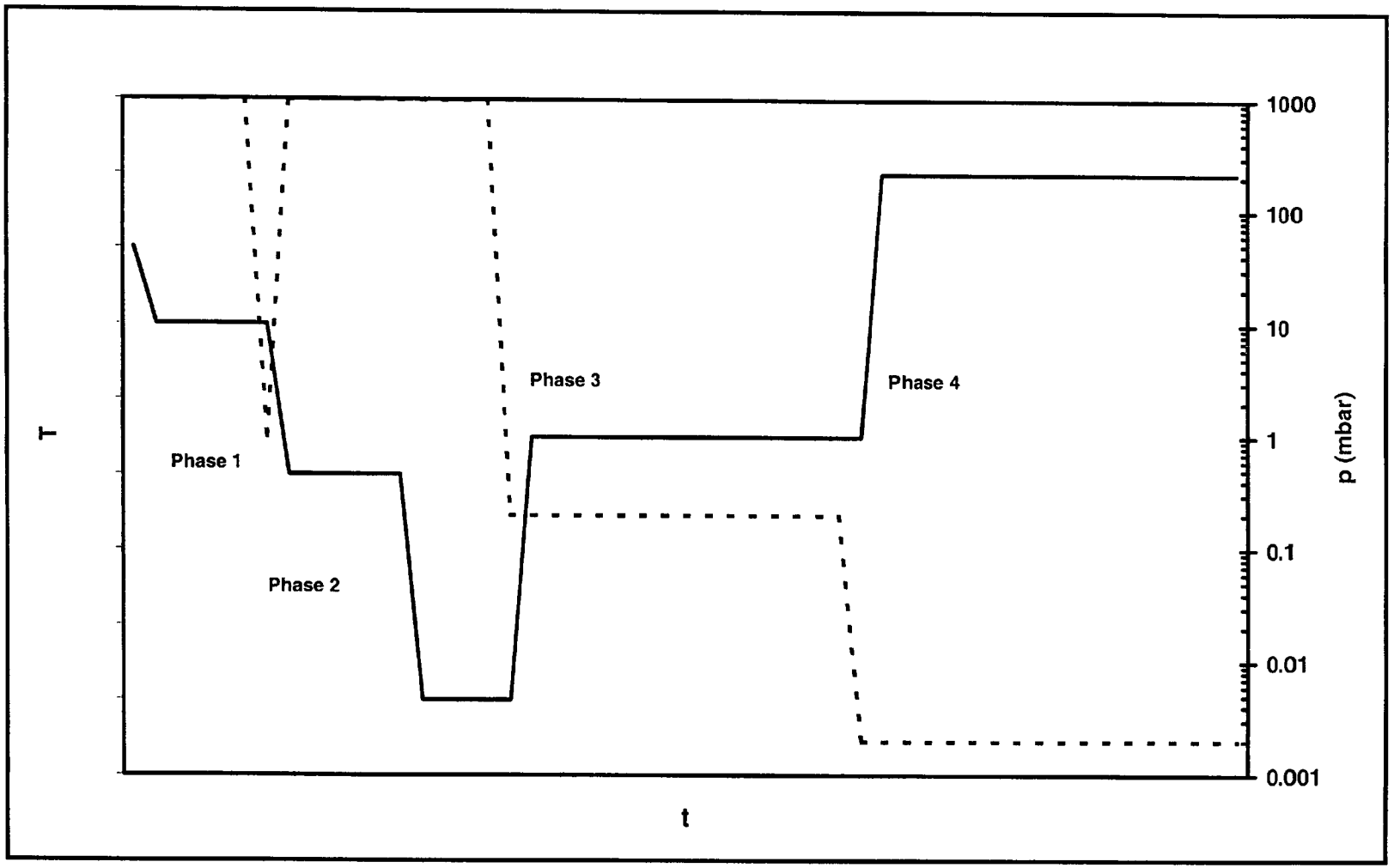

FIG. 5 shows the inventive method having precooling and pressure reduction (phase 1), crystallization (phase 2) and subsequent primary and secondary drying (phases 3 and 4).

Figure 6:
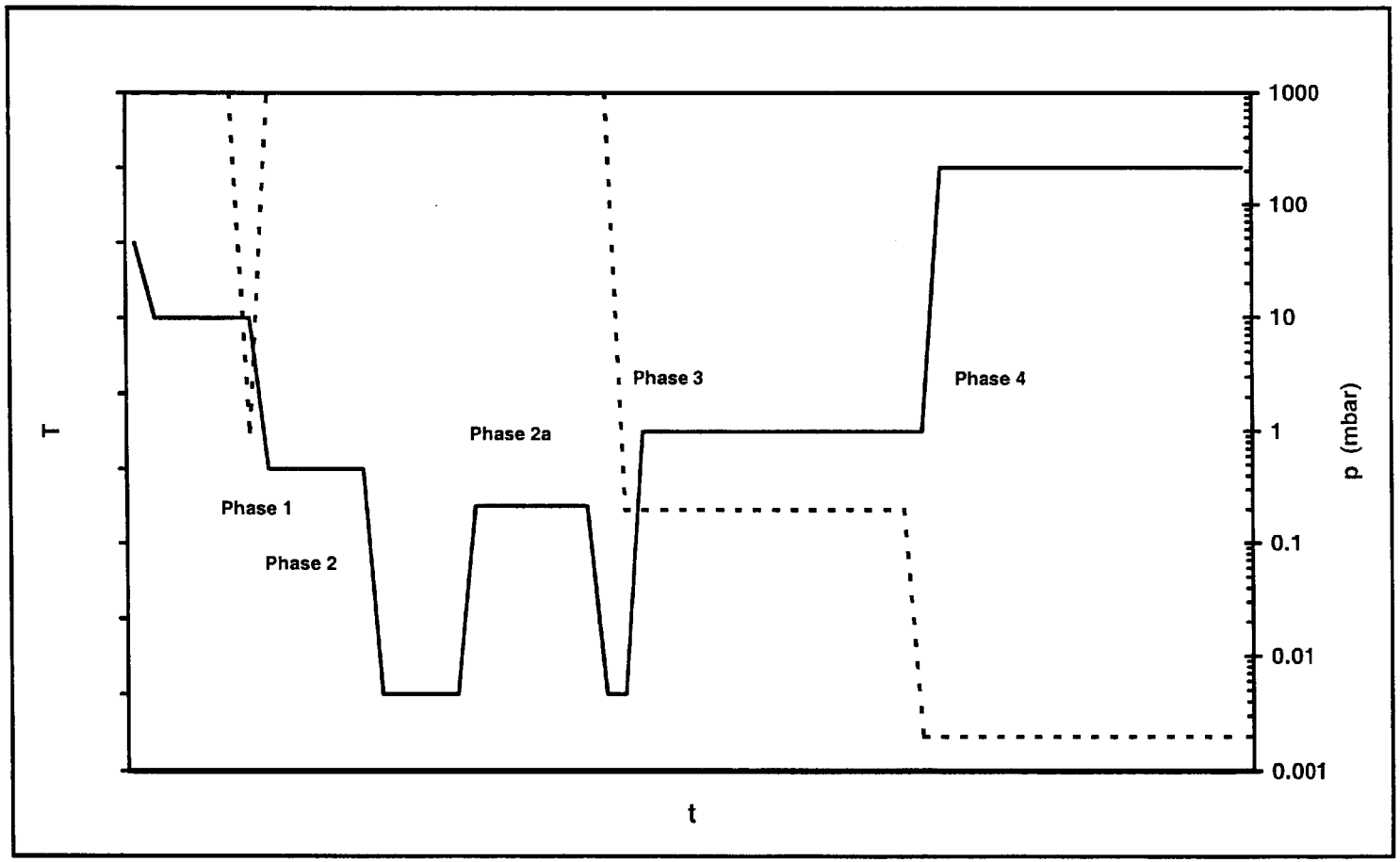

FIG. 6 shows the inventive method having precooling and pressure reduction (phase 1), crystallization (phase 2), tempering step (phase 2*a*) and subsequent primary and secondary drying (phases 3 and 4).

Figure 7:
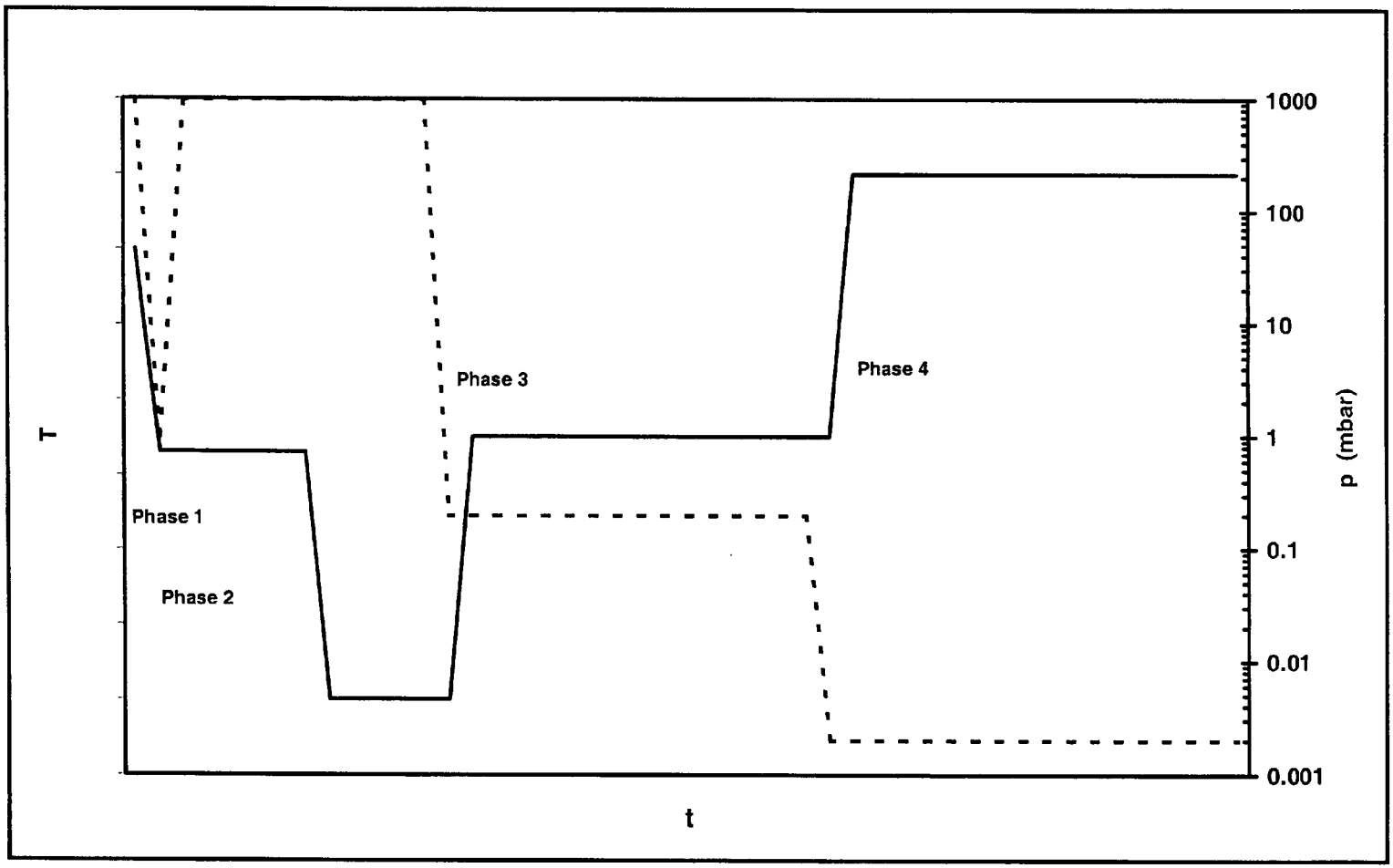

FIG. 7 shows the inventive method having pressure reduction (phase 1), crystallization (phase 2) and subsequent primary and secondary drying (phases 3 and 4).

The lyophilizates which can be produced by the inventive method exhibit improved structural cohesion and are less severely mechanically damaged by the escaping vapor stream, even at elevated sublimation rates, than lyophilizates which are produced by methods of the prior art. They display less pronounced collapse phenomena.

The residual moisture contents which can be achieved by the inventive method are in principle comparable with those which are achieved by freeze-drying according to the prior art (see tab. 3)

Suitable preparations for use in the inventive method are preparations with or without cake-forming agents. Using such cake-forming agents, during freeze-drying, a porous cake or a matrix can be produced. Preference is given to freeze-drying products which are produced with the use of cake-forming agents or other substances which, on account of their physicochemical properties, are suitable as cake-forming agents.

Particular preference is given to freeze-drying products which are produced with the use of cake-forming agents selected from the class of compounds amino acids, carbohydrates (monosaccharides, disaccharides, sugar alcohols, oligosaccharides, polysaccharides), peptides, polymeric compounds and salts. Most preference is given to those which are produced with the use of cake-forming agents selected from the group consisting of mannitol, sucrose, maltose, glycine and sodium chloride.

TABLE 1

List of the cake-forming agents preferably used

| | |
|---|---|
| Amino acids | Glycine |
| | Alanine |
| | Aspartic acid |
| Peptides | Gelatin |
| | Collagen |
| | Albumin |

TABLE 1-continued

| List of the cake-forming agents preferably used | |
|---|---|
| Monosaccharides | Glucose |
| | Lactose |
| Disaccharides | Maltose |
| | Sucrose |
| | Trehalose |
| Oligosaccharides | Cyclodextrins |
| | Maltodextrins |
| Polysaccharides | Starch and starch derivatives |
| | Cellulose and cellulose derivates |
| Polymers | Polyvinylpyrrolidones |
| | Polyethylene glycols |
| Salts | Sodium chloride |
| | Calcium carbonate |
| Sugar alcohols | Mannitol |
| | Sorbitol |
| | Xylitol |

A multiplicity of solvents come into consideration for the inventive method. For the sake of better understanding, in the description predominantly aqueous systems are covered. However, the invention explicitly also relates to nonaqueous systems. Preferably, aqueous solutions are used.

Exemplary Embodiments

Procedural Systems for Freeze-drying Using the Inventive "Vacuum-induced" Freezing and Methods According to the Prior Art Starting reagents, materials and apparatus A 5% strength aqueous solution of mannitol was prepared and sterile-filtered through a 0.2 $\mu$m membrane filter.

3 ml of the solution were placed in 10R tube glass vials and freeze-drying stoppers were attached.

For the freeze-drying, the filled vials were placed in a freeze-dryer from Kniese (adjustable area 0.6 $m^2$).

Procedure

The solution was precooled on the adjustable shelves at +10° C.

Figure 1:
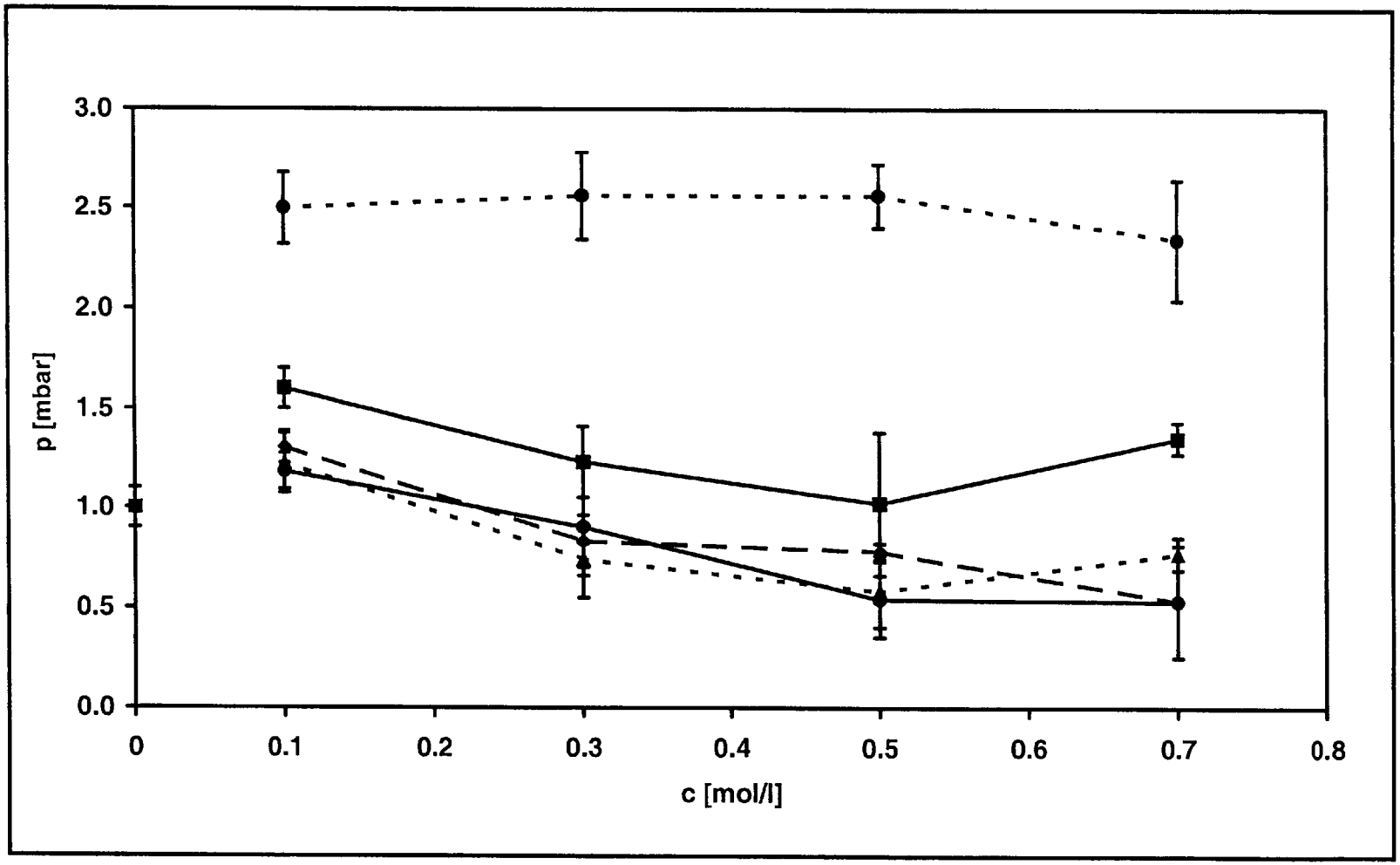
Figure 2:
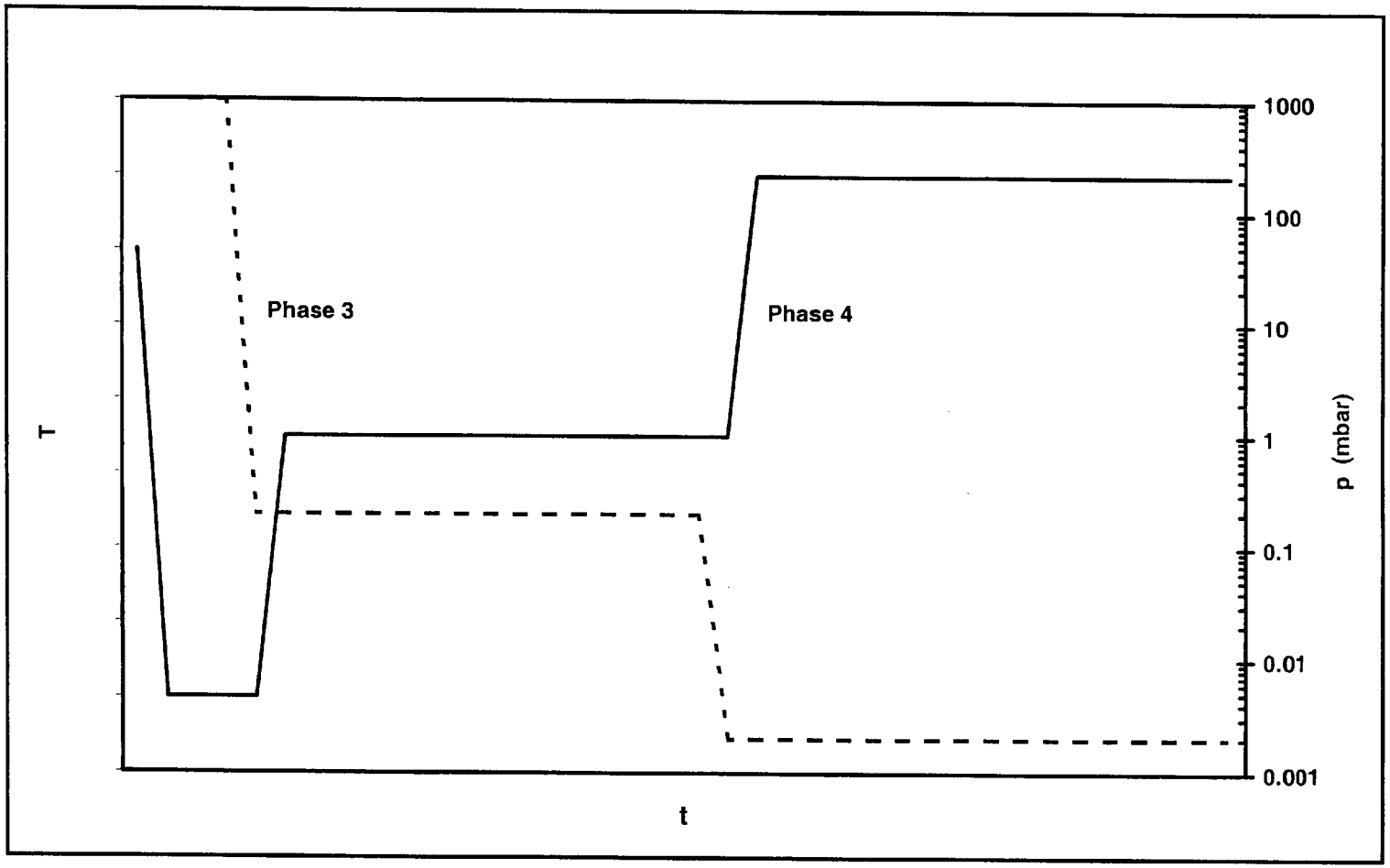
FIG. 2 shows a conventional production method of the prior art.
Figure 3:
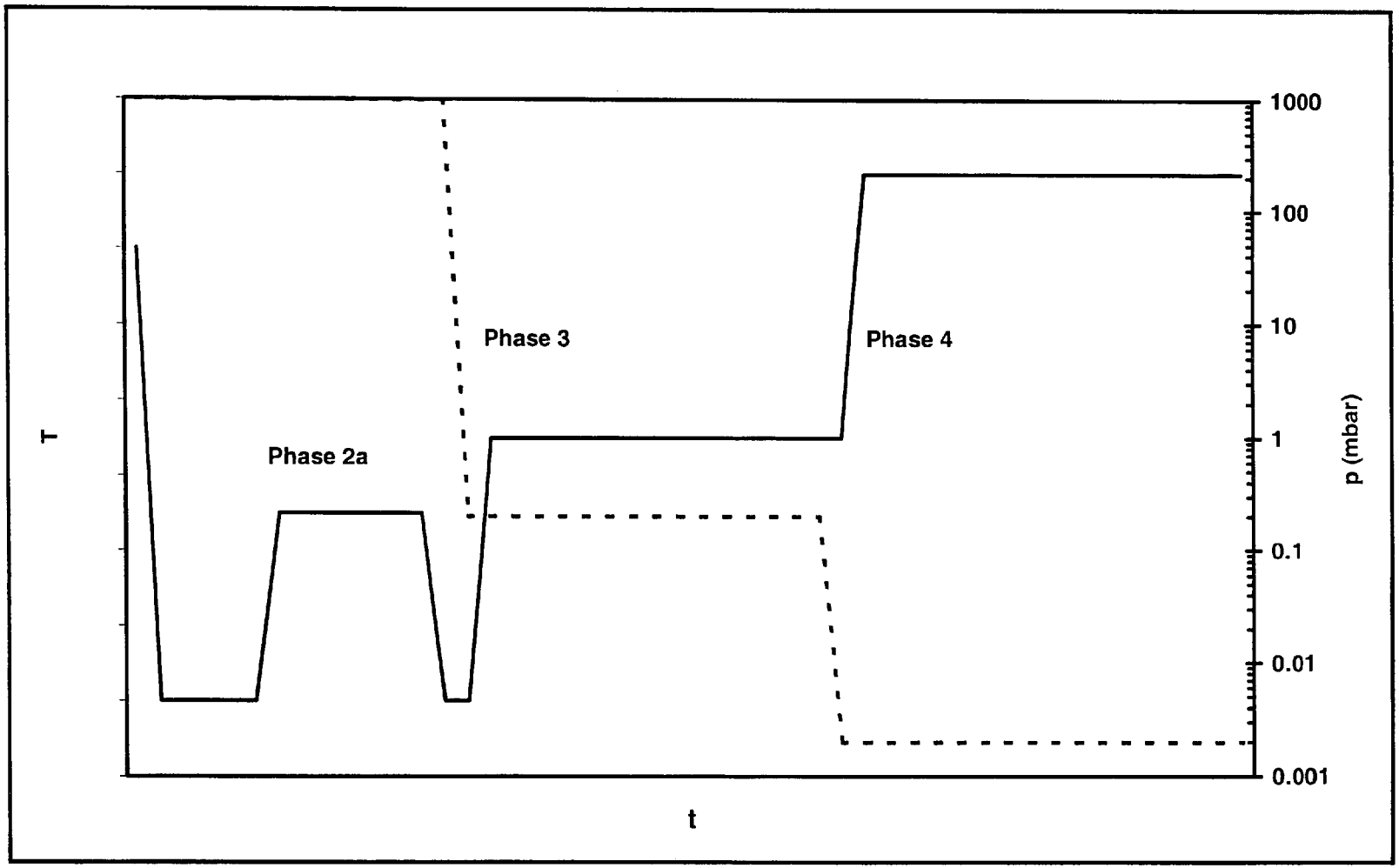
FIG. 3 shows a conventional production method having a tempering step of the prior art.

The chamber pressure was then reduced to 0.65 mbar (see FIG. 1 for parameter selection).

After the pressure of 0.65 mbar is reached and partial freezing has started on the product surface, the system was vented to ambient pressure and simultaneously the adjustable shelves were brought to a temperature which can be, for example, −7.5° C. for mannitol.

The products were each kept for 1 hour at the respective temperature and were then cooled to −40° C. (freezing variant III).

Freezing was followed by a primary drying over the course of 8 hours at +40° C. and 1.6 mbar without secondary drying. The events observed were reported in table 2.

The reference used was corresponding solutions which were not subjected to the "inventive" vacuum-induced freezing (freezing variant III), but were frozen at 2K/min to −40° C. (freezing variant I) and the occurrence of subcooling, or were rapidly frozen in a cold bath to −60° C. (freezing variant II) and were then freeze-dried under the same conditions.

TABLE 2

Unwanted changes and damage to the product cake at various freezing temperatures and primary drying at shelf temperature (+40° C.). A weighting of severity and frequency of the damage which occurred was performed using (−), that is to say none, (+) slight, (++) severe and (+++) very severe.

| Freezing method | 5% strength mannitol solution |
|---|---|
| Variant I | Surface split open in many samples, lyophilizates collapsed on the vial bottom (++) |
| Variant II | Many lyophilizates collapsed on the vial bottom; product cake torn apart (+++) |
| Variant III | (−) |

Procedural Systems for Freeze-drying Using the Inventive "Vacuum-induced" Freezing (variant III), and Using the Inventive "Vacuum-induced" Freezing with Subsequent Thermal Treatment (variant IV)

Starting Reagents, Materials and Apparatus

An aqueous 2% strength solution of mannitol was prepared and the solution was sterile-filtered through a 0.2 $\mu$m membrane filter.

3 ml of the solution were placed in 10R tube glass vials and freeze-drying stoppers were attached.

For the freeze-drying, the vials were placed in a freeze dryer from Kniese (adjustable surface 0.6 $m^2$).

Procedure

The solutions were precooled on the adjustable shelves at +10° C.

The chamber pressure was then reduced to 0.65 mbar (see FIG. 1 for choice of parameters).

After the pressure of 0.65 mbar was achieved and partial freezing on the product surface began, the system was vented to ambient pressure and at the same time the adjustable shelves were brought to a temperature which can be, for example, −7.5° C. for mannitol.

The products were each kept for 1 hour at the respective temperature and then cooled to −40° C. (variant III).

For variant IV, the samples/samples were warmed to −3° C. after the procedure of variant III, tempered for 4 hours at this temperature and then cooled to −40° C.

As reference, samples were frozen to −40° C. at a cooling rate of 2 K/min. The samples subcooled in the course of this. (variant I).

The freezing according to variant I, III or IV was followed by a primary drying over the course of 20 hours at −10° C. and 0.2 mbar and a secondary drying at +40° C. and 0.2 mbar over the course of 2 hours.

After the freeze-drying, in addition, the residual moisture of the lyophilizates was determined by a Karl-Fischer titration:

TABLE 3

Dependence of residual moisture and drying time on freezing method.

| Mannitol 2% | Residual moisture [%] | Sublimation period [min] |
|---|---|---|
| Vacuum-induced freezing (variant III) | 1.41 | 810 |
| Vacuum-induced freezing and thermal treatment (variant IV) | 0.18 | 864 |
| Reference (variant I) | 0.86 | 1066 |

What is claimed is:

1. A method for freeze-drying a solvent-containing preparation in a drying chamber comprising the steps of cooling the preparation and crystallizing the solvent and sublimation of the resulting frozen solvent by means of reduced pressure, in which the method is carried out as follows:

Phase 1: reducing the pressure in the drying chamber until the onset of a visible crystallization of the solvent at a temperature in the drying chamber which is above the solidification point of the preparation;

Phase 2: reducing the temperature in the drying chamber to a temperature which is below the solidification point of the preparation or is identical to it, until completion of the crystallization of the solvent, resulting in frozen solvent;

Phase 3: sublimation of the frozen solvent by means of reduced pressure.

2. The method as claimed in claim 1, characterized in that an aqueous solution is present.

3. The method as claimed in claim 1, characterized in that the pressure in phase 1 is reduced to 0.1 to 6 mbar in the case of aqueous preparations.

4. The method as claimed in claim 3, characterized in that the pressure in phase 1 is reduced to 0.2 to 3 mbar.

5. The method as claimed in claim 1, characterized in that the temperature in phase 2 is from −60° C. to 0° C. in the case of aqueous preparations.

6. The method as claimed in claim 1, characterized in that a tempering step (phase 2*a*) is carried out, in which a temperature is set which is above the glass transition temperature (Tg') of any amorphously solidified solution remaining after phase 2 and below the solidification point of the preparation.

7. The method as claimed in claim 1, characterized in that the temperature at the start of phase 3 is from −60° C. to 0° C. in the case of aqueous preparations.

8. The method as claimed in claim 1, characterized in that a cake-forming agent is used.

9. The method as claimed in claim 8, characterized in that the cake-forming agent is mannitol, sucrose, maltose, glycine or sodium chloride.

* * * * *